United States Patent [19]

Perutz

[11] Patent Number: 4,865,111

[45] Date of Patent: Sep. 12, 1989

[54] DISPLAY SYSTEM

[75] Inventor: Simon G. A. Perutz, Evanston, Ill.

[73] Assignee: Nimlok Company, Niles, Ill.

[21] Appl. No.: 224,317

[22] Filed: Jul. 26, 1988

[51] Int. Cl.[4] ..... A47G 5/00

[52] U.S. Cl. ..... 160/135; 160/351; 160/352

[58] Field of Search ..... 160/135, 351, 352, 132; 135/87; 52/239, 36; 40/606, 610, 611, 603, 604

[56] References Cited

U.S. PATENT DOCUMENTS

| | | | |
|---|---|---|---|
| 1,444,522 | 2/1923 | Pedlar | 160/135 |
| 2,203,500 | 6/1940 | Loggins | 292/341.17 X |
| 2,261,141 | 11/1941 | Davis | 160/352 |
| 2,266,854 | 12/1941 | Davis | 160/352 X |
| 2,665,152 | 1/1954 | Piercey | 292/341.17 X |
| 4,434,900 | 3/1984 | Cook | 52/36 X |
| 4,491,166 | 1/1985 | Hanna | 160/351 |
| 4,625,477 | 12/1986 | Johnstonbaugh | 52/239 X |
| 4,774,792 | 10/1988 | Ballance | 52/239 X |

*Primary Examiner*—Ramon S. Britts
*Assistant Examiner*—David M. Purol
*Attorney, Agent, or Firm*—Neuman, Williams, Anderson & Olson

[57] ABSTRACT

A display system is provided having a plurality of interconnected display panels relatively adjustable to form an upright partition. At least one of the panels is an end panel having an exposed upright edge. A trim assembly is also provided which includes a wall member of relatively stiff, yet bendable, material removably mounted on and concealing the end panel upright edge. The wall member is provided with opposed substantially inflexible marginal segments to which are connected bracing elements. The bracing elements are adapted to selectively engage one another and maintain the trim wall member in a predetermined non-planar configuration when the wall member is mounted on the end panel upright edge. When the wall member is disengaged from the end panel upright edge and the bracing elements are disengaged from one another, the wall member may assume a substantially planar configuration.

10 Claims, 2 Drawing Sheets

FIG. 4
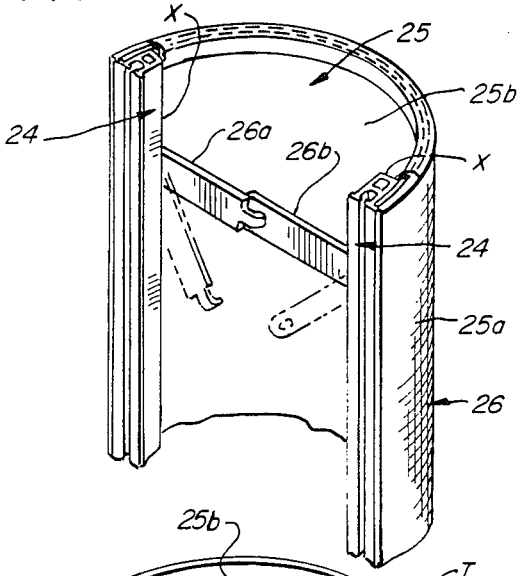
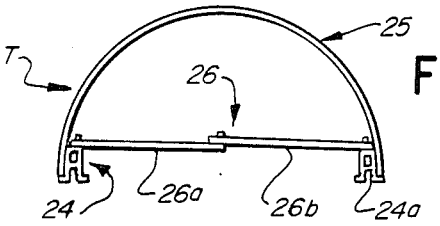
FIG. 5
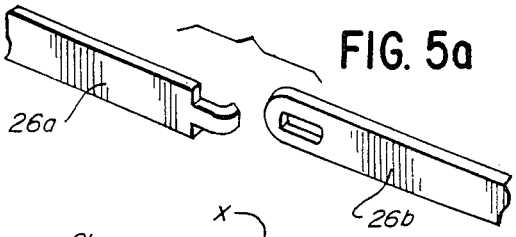
FIG. 5a
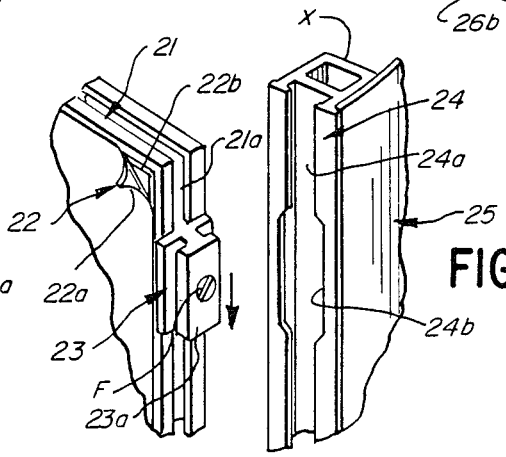
FIG. 7
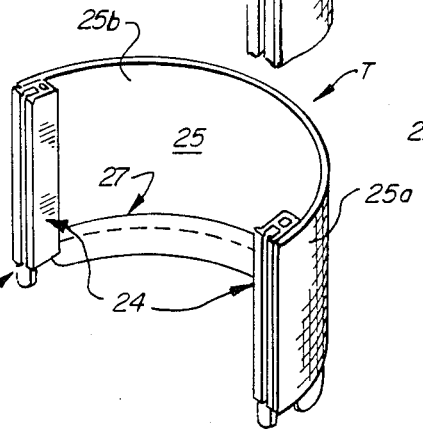
FIG. 6
FIG. 8
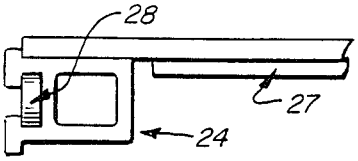
FIG. 9
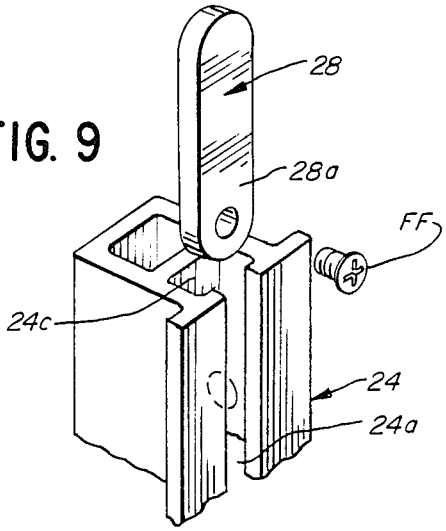
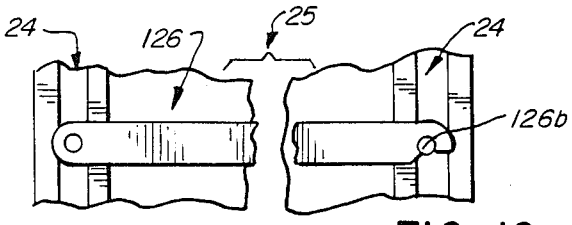
FIG. 10
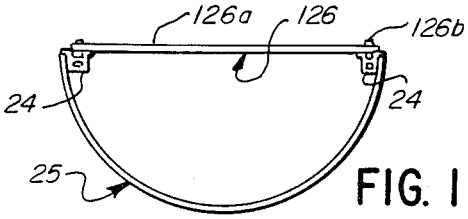
FIG. 11
FIG. 12
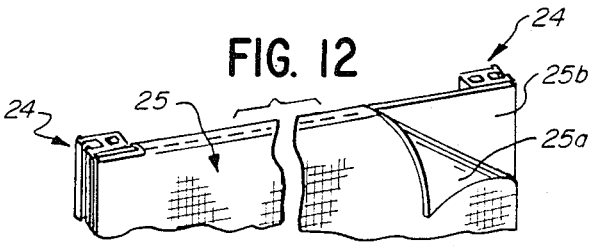

DISPLAY SYSTEM

BACKGROUND OF THE INVENTION

Various types of display systems are commonly utilized at trade fairs, retail stores and the like for providing temporary structures on which products and/or advertising graphics may be displayed, mounted and supported in an attractive eye-appealing manner. Such systems frequently incorporate a plurality of display panels which are interconnected and adjustable relative to one another so as to form partitions or walls of various sizes and shapes. Heretofore the erection and dismantling of such a display system was normally a time-consuming labor intensive operation involving a variety of tools and fixtures. When in a dismantled state, the prior display systems incorporated an inordinate number of component parts of special design which frequently became lost or mislaid, thereby rendering subsequent erection of the display system an awkward and frustrating experience. Furthermore, when the prior display systems were in a dismantled state, the various component parts could not readily interfit with one another so as to form a convenient, portable, compact, lightweight unit suitable for storage and shipping. When erected, prior display systems oftentimes had exposed edges of the end display panels which were unattractive and gave a visual impression that the erected system was weak and unstable. To conceal such exposed panel edges in many instances involved the utilization of costly, complex, preformed pieces which were awkward and difficult to install and when disassembled, were difficult to pack or interfit with other components to form a compact unit for storage or shipment.

SUMMARY OF THE INVENTION

Thus, the improved display system readily avoids the aforenoted shortcomings besetting prior display systems of this general type.

The improved display system incorporates a minimum number of component parts which are of simple, yet sturdy, construction and may be readily erected without the need for tools or personnel possessed of special mechanical skills or manual dexterity. The erection or dismantling of the improved display system is expeditiously accomplished with minimal manual effort or personnel.

The size and shape of the display system may vary over a wide range so as to effectively function in a manner as desired and at the same time provide an attractive, eye-appealing structure.

In accordance with one embodiment of the invention the improved display system embodies a plurality of hingedly connected display panels which are manually adjustable and when the system is erected, form a partition or booth-like structure. One panel of the partition forms an end panel having an exposed upright edge. Removably mounted on and concealing the exposed upright edge is a trim assembly which includes one or more wall units, each of which is provided with a thin wall member formed of a relatively stiff, yet bendable material. The wall member is provided with opposed substantially inflexible marginal supports, at least one of which is provided with means for interlockingly engaging and substantially concealing the end panel exposed upright edge. Mounted on the opposed marginal supports is an adjustable bracing means, which, in one position of adjustment, retains the wall member in a predetermined configuration.

DESCRIPTION

For a more complete understanding of the invention reference is made to the drawings wherein FIG. 1 is a fragmentary front perspective view of one embodiment of the improved display system and showing one trim assembly thereof in exploded relation with respect to the adjacent end display panel.

FIG. 4 is a fragmentary perspective view of the upper end portion of the wall unit of FIG. 3 when the latter is assuming a predetermined semi-cylindrical configuration.

FIG. 5 is a top plan view of the wall unit of FIG. 4.

FIG. 5*a* is an enlarged fragmentary top perspective view of the distal ends of the bracing means components of FIG. 5 but in an unlocked relation.

Figure 3:
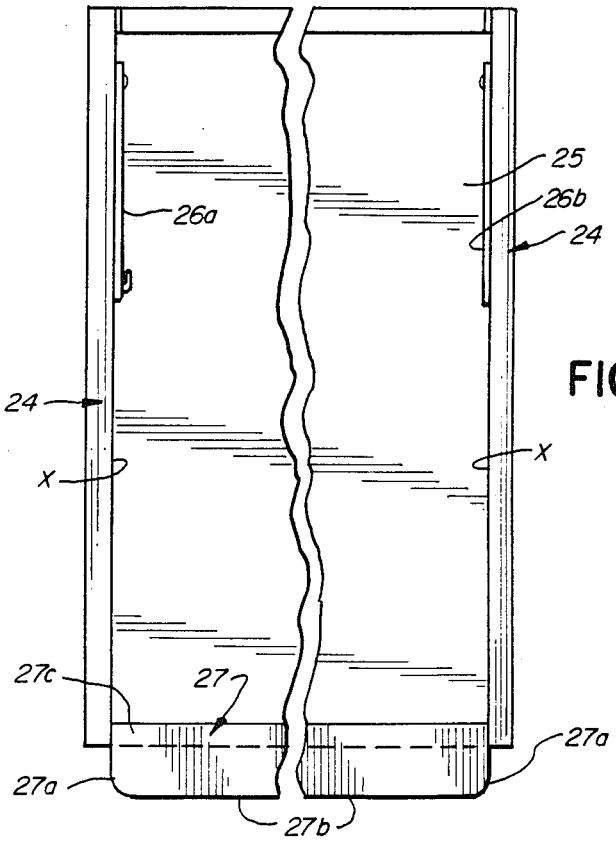
FIG. 3 is a back elevational view of the uppermost wall unit shown in FIG. 2 and with the wall member thereof assuming a planar configuration.

FIG. 6 is a fragmentary perspective view similar to FIG. 4 but showing the lower end portion of the wall unit of FIG. 3.

FIG. 7 is an enlarged, fragmentary, perspective view of an end display panel exposed upright edge and a corresponding marginal support of one trim assembly wall member shown in a disassembled relation.

FIG. 8 is an enlarged fragmentary bottom view of the wall member of FIG. 3.

FIG. 9 is an enlarged fragmentary perspective view of a device for connecting and locating adjacent wall units of a trim assembly; the components thereof being shown in exploded relation.

FIGS. 10 and 11 are fragmentary back and top views respectively of a modified form of bracing means and showing the components thereof in an interlocking relation.

FIG. 12 is a fragmentary top perspective front view of the wall member of FIG. 3 and showing a laminated covering therefor with the outer lamina thereof partially delaminated.

Figure 1:
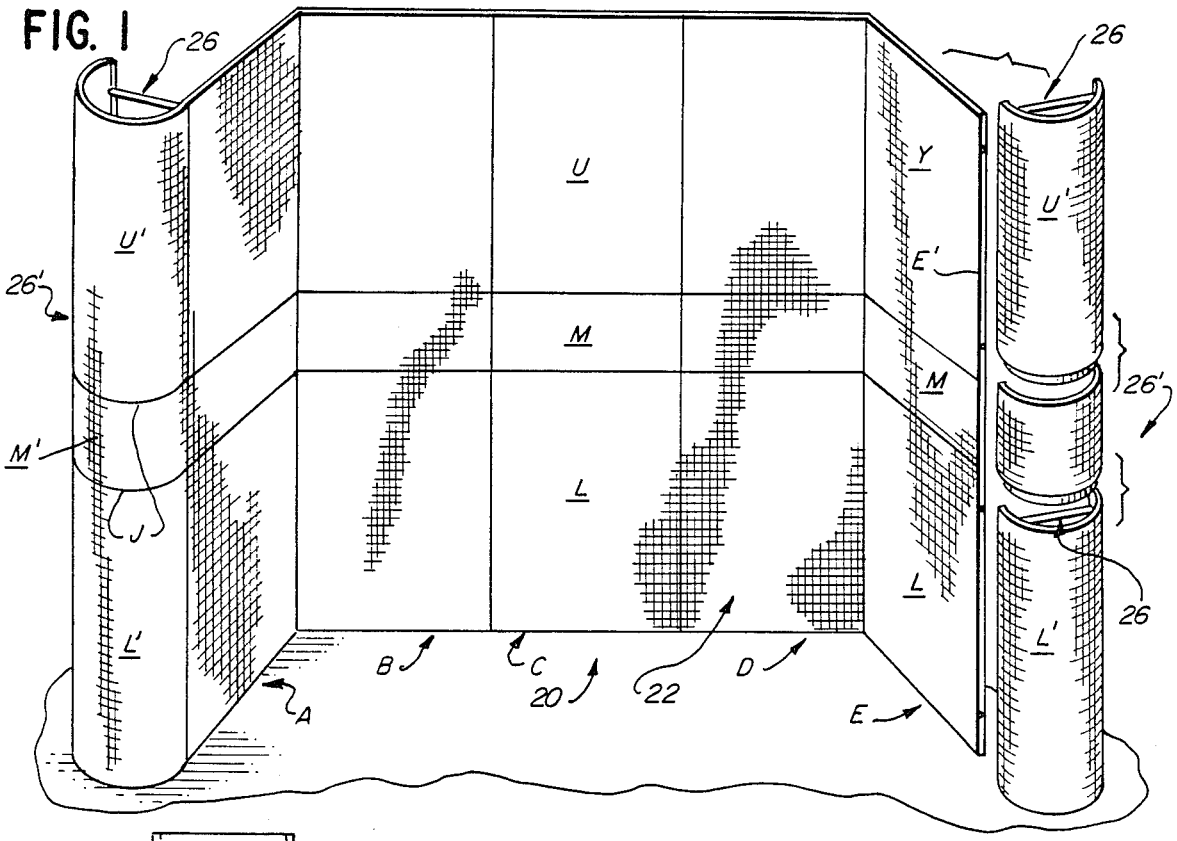
Figure 2:
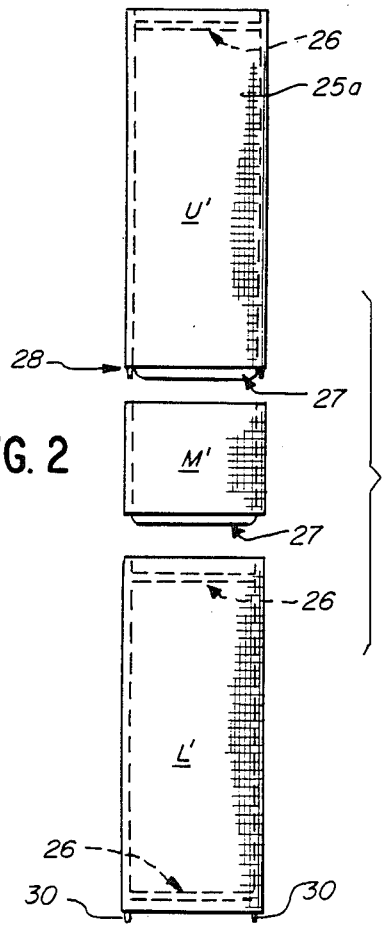
FIG. 2 is a front elevational view of the trim assembly per se shown in FIG. 1 with wall units thereof in exploded relation.

Referring now to the drawings and more particularly to FIG. 1, one embodiment of the improved display system 20 is shown in a set up or erected condition. Headers, shelves and similar accessories have been omitted in the illustrated system because such accessories form no part of the invention hereinafter described and claimed.

System 20, as illustrated, includes a plurality of vertically disposed inflexible display panels A, B, C, D and E which are interconnected along their vertical edges so as to form a display booth or similar structure. The connection between adjacent panels may be of a hinge type such as disclosed in applicant's pending U.S. patent application, Ser. No. 057,382, filed Jun. 2, 1987. In the illustrated embodiment, each panel A-E includes an upper wall section U, a middle wall section M, a lower wall section L. The wall sections, as shown, are arranged and interlocked in a vertically aligned relation so as to form an inflexible rectangular panel. In lieu of each panel being formed of a plurality of units, it may comprise but a single unit. The type of panels incorporated in the display system 20 will depend upon the visual effects and functional features desired. Each panel is of lightweight (e.g. about 4 lbs.) relatively thin (e.g. about 1") construction and includes a rectangular frame 21 formed preferably of extruded lightweight metal side and end sections, interconnected by suitable means, not shown, so as to form a strong, rigid frame of desired shape (e.g. rectangular) having miter joints.

Affixed by suitable adhesives to at least the exposed surface of each display panel frame is preferably a laminated covering 22, see FIG. 7. An outer, or exposed, lamina 22*a* of the covering may be of a suitable decorative fabric which has been treated to resist soiling and the inner, or concealed, lamina 22*b* may be of an opague relatively stiff backing material. The outer laminas of the display panel wall sections may be of matching or contrasting colors. Disposed within the frame and providing support for the covering 22 is a rigid, yet lightweight, core member, not shown. Normally, the back side of the frame has attached thereto a similar covering so that both the front and back sides of the display panel have a finished look. It is preferred that the frame be concealed by the covering when viewing the front side of the panel.

The corresponding wall sections of adjacent display panels are preferably hingedly interconnected so that when display system 20 is to be dismantled, the adjacent wall sections will fold relative to one another into superposed face to face relation. If desired, the wall sections of a given display panel may remain assembled or disassembled when the system is in a dismantled state.

As seen in FIG. 7, the frame side section 21 forming the exposed upright edge of the end panel is provided with a longitudinally extending groove 21*a*, which is adapted to accommodate one side of a link piece 23. The piece 23 is retained in a selected location within the groove by a suitable fastener F. The number of longitudinally spaced link pieces 23 on the exposed edge of the end panel will depend upon the length of the frame side section 21. Each piece 23 preferably has an exposed T-shaped segment 23*a* projecting laterally outwardly from the groove 21*a*. The segment 23*a* is sized so that it will slidably fit within a longitudinally extending groove 24*a* formed in a marginal stiffening member or support 24, the latter and a wall member 25 comprising components of a wall unit L' or U' of the trim assembly 26' to be hereinafter described. The number of wall units comprising the trim assembly will normally correspond to the number of wall sections U, M, L comprising the end display panel A or E.

Each wall member 25 of the trim assembly is affixed to a pair of marginal stiffening members or supports 24 which are disposed in spaced substantially parallel upright relation, see FIG. 3. The parallel members 24 are preferably extruded metal and of tubular configuration and have an elongated exposed groove 24*a* formed on one side thereof. Each groove 24*a* is provided with a plurality longitudinally spaced, enlarged, passages 24*b* which facilitate lateral positioning of the T-shaped segment 23*a* into the groove 24*a*. Spanning the pair of stiffening members 24 and connected thereto is the wall member 25 which is of thin, relatively stiff, yet bendable material. The wall member is preferably of rectangular configuration and may be of a laminated construction having an outer, or exposed, lamina 25*a* of a material similar to that utilized for the outer lamina of the display panels A–E. The inner lamina 25*b* of the wall member 25 may be of plastic sheet material. The wall member 25 must be capable of assuming a semi-cylindrical configuration without cracking, splitting or taking a permanent set. In other words, when the trim assembly is dismantled from the end display panel A or E, the wall member will tend to readily resume a flat planar configuration.

Attached to opposing surfaces X of the stiffening members 24 are components 26*a*, 26*b* of a bracing unit 26 which interconnect with one another to retain the wall member 25 in a predetermined configuration, see FIG. 4. Components 26*a*, 26*b* in one embodiment are elongated arms, each having one end thereof pivotally connected to surface X of the corresponding stiffening member 24. The free or distal ends of the arms 26*a*, 26*b* are provided with complemental locking means (e.g. hook and eye). When the arms are in locking engagement they form a substantially diametrical chord for the semi-cylindrical wall member. When the arms are disengaged they will assume depending positions in face to face relation with the surfaces X, see FIG. 3.

FIGS. 10 and 11 disclose a modified bracing unit 126 wherein one component 126*a* comprises a hinged latch arm and component 126*b* comprises a pin or catch. The length of the latch arm 126*a* is substantially equal to the diametrical chord of the semi-cylindrical wall member 25, see FIG. 11.

Various other types of bracing units may be utilized such as a flexible strap having the free ends thereof provided with conventional snap fasteners or Velcro patches. In some instances, it might be desirable to have the wall member 25 assume a configuration other than semi-cylindrical. In such a situation the length of one, or more, of the bracing unit components would be longer or shorter than shown in either FIG. 4 or 11.

Where the trim assembly includes a plurality of individual units arranged in vertically aligned relation as shown in FIG. 1, one of the edges of one of the adjacent wall units defining a joint J therebetween, is provided with an extension piece 27, the latter being formed of a relatively wide strip of thin, relatively stiff, yet bendable material similar to that utilized as the inner lamina 25*b* of the wall member 25. Piece 27 substantially spans the distance between the stiffening members 24. The projecting corners 27*a* of the piece are rounded or beveled, or the vertically extending sides of the piece may be tapered towards one another so as to facilitate slidably positioning the projecting portion 27*b* of the piece 27 into face to face relation with the backside of the wall member of the other adjacent unit. When the adjacent units are in assembled relation, the extension piece 27 assists in maintaining the adjacent units in proper vertical alignment and prevents any gaps being formed in the joint through which light rays might pass. The non-projecting portion 27*c* of the extension piece 27 may be affixed by any suitable means to the backside of the said one adjacent unit adjacent a marginal segment thereof, the latter being angularly disposed relative to members 24.

In addition to the extension piece, the marginal stiffening members 24 of one of the adjacent units are provided with a pintle or studlike element 28, see FIGS. 8 and 9. One end 28*a* of the pintle extends endwise into one end 24*c* of the groove 24*a* formed in a corresponding one member 24 of an adjacent unit. The inserted end 28*a* of the pintle is affixed to the member 24 by a suitable fastener FF, see FIG. 9. The pintle 28 is sized so that the end thereof will slidably fit within the corresponding end of the groove of the adjacent stiffening member 24 and thus, retain the latter in proper endwise alignment.

The pintles also provide reinforcement of the joints formed between the adjacent wall units.

The lower ends of the stiffening members 24 of the lower wall unit L' may be provided with removable feet 30 having stem portions, not shown, which snugly slide within the lower ends of the member grooves 24*a*.

In setting up the display system 20, the display panels A–E, if adjacent panels are hingedly interconnected, are disposed in an upright position and unfolded relative to one another so as to assume the desired angular positions. As seen in FIG. 1, display panels B, C, and D assume a substantially planar relation and the end display panels A and E extend divergently outwardly therefrom. When the end panels are so disposed, each will have an exposed vertical edge. Only exposed edge E' of end panel E is shown in FIG. 1. The link pieces 23 are normally factory installed at selected locations along the exposed edge of the end display panel A or E.

The lower wall unit L' of the trim assembly 26'is initially assembled on the exposed edge of the lower wall section L by laterally aligning the protruding T-shaped portions 23*a* of the link pieces with the enlarged passages 24*b* formed in the groove 24*a* of one of the marginal stiffening members 24 whereby the portions 23*a* are then inserted into the groove 24*a* whereupon the lower unit slides downwardly a short distance within the groove locking together the lower section of the end panel and the lower unit of the trim assembly 26'.

Either prior to, or after, one of the members 24 of the lower unit L' has been assembled on the exposed edge of the lower section, the wall member 25 is manipulated into a semi-cylindrical configuration and the components of the bracing unit 26 or 126 are interconnected so as to retain the wall member 25 in its desired configuration. It is preferred that the wall member of the lower wall unit L' be provided with a pair of bracing units; one adjacent the upper edge portion thereof and the other adjacent the lower edge portion.

In some instances, the person setting up the display system, might find it more convenient to assemble the wall member of the middle unit M' on the lower unit L' by interconnecting the corresponding marginal members 24 in aligned endwise relation with the pintles 28 of one unit being slidably interfit in the groove ends 24*c* of the other unit before interconnecting the bracing components of the lower unit L'. When the pintles 28 are in sliding interfit relation with the ends of the stiffening member grooves 24*a*, the extension piece 27 provided on one of the adjacent units will span the joint J formed between the units L' and M' and engage the backside of the other adjacent unit.

A procedure similar to that for assembling the lower unit L' to the lower section L of the end panel A or E is followed in assembling the upper wall unit U' on the exposed edge of the upper section U of end panel.

As shown in FIG. 1 the middle unit M' has a vertical dimension which is substantially less than either the upper or lower unit. Furthermore, unit M' is shown disposed between units L' and U'. The invention as herein disclosed and claimed is not intended to be limited to such dimension differentials and arrangements as shown in the drawings. For example, units L' and U' may be adjacent one another and the unit M' located at either the top or bottom of the trim assembly. In addition, the number of units comprising the assembly 26' may be greater or less than shown.

Thus, a display panel system has been disclosed which is of simple construction, is attractive in appearance, easy to set up or dismantle with a minimal amount of manual effort and without the need for special tools or fixtures, and when dismantled, the component parts of the system are capable of cooperating with one another to form a portable, compact unit suitable for storage and shipment.

I claim:

1. A display system comprising a plurality of interconnected display panels adjustable between operative and inoperative modes, when in an operative mode, said panels coacting to form a partition having front and back sides, at least one of said panels being an end panel having an exposed upright edge; and trim means removably mounted on the end panel exposed upright edge, said trim means being adjustable between operative and inoperative conditions, said trim means including a relatively stiff, yet bendable, thin wall member, the latter being adapted to assume a substantially planar configuration when said trim means is in the inoperative condition, said wall member having a pair of opposed substantially inflexible, first marginal segments and opposed substantially flexible second marginal segments intermediate said first marginal segments; one first marginal segment being provided with connecting means and adapted, when the trim means is in an operative condition, to be aligned with the end panel upright edge and interlockingly engage and substantially conceal the end panel upright edge, the other first marginal segment being laterally offset rearwardly from the said one first marginal segment and spaced from the back side of the partition, and adjustable bracing means disposed on said first marginal segments and when the trim means is in an operative condition, coacting with the first marginal segments to maintain the said other first marginal segment in the laterally offset rearward relation with said one first marginal segment whereby the wall member assumes a predetermined non-planar configuration, said bracing means being concealed from the front side of the partition when the trim means is in the operative condition and connected to the end panel upright edge.

2. The display system of claim 1 wherein the wall member assumes a substantially semi-cylindrical configuration when said bracing means is coacting with the first marginal segments.

3. The display system of claim 1 wherein the opposed first marginal segments of the wall member of said trim means are in spaced substantially parallel relation.

4. The display system of claim 1 wherein the bracing means includes a substantially inflexible first element hingedly mounted on one of said first marginal segments and lockingly engaging a complemental second element mounted on the other first marginal segment when the trim means is in said operative condition.

5. The display system of claim 1 wherein the trim means includes a plurality of units arranged in abutting vertically stacked relation when mounted on the end panel upright edge, said stacked units being substantially coextensive with the end panel upright edge when mounted thereon; each unit being provided with a wall member and adjustable bracing means for maintaining the unit wall member in said predetermined non-planar configuration, one of a pair of adjacent abutting units in the stack being provided with aligning means cooperating with the other unit of the pair to maintain said adjacent units in vertically aligned relation.

6. The display system of claim 1 or 5 wherein the wall member has a finished front surface observable from the partition front side when the wall member assumes the predetermined non-planar configuration and the trim is in the operative condition and mounted on the end panel upright edge.

7. The display system of claim 4 wherein the bracing means second element is substantially inflexible and is hingedly mounted on the said other first marginal segment, said first and second elements having corresponding distal ends which interlock with one another when the trim means is in said operative condition.

8. The display system of claim 1 wherein, when the display panels are in the operative mode, said panels are adapted to assume a stacked face to face relation and the trim means is disengaged from the end panel upright edge, and the bracing means is in an inoperative mode wherein the wall member is adapted to be disposed in a stacked face to face relation with one of the stacked display panels and cooperates therewith to form a compact, portable structure.

9. The display system of claim 4 wherein the first element of the bracing means defines a hingedly mounted latch and the second element of the bracing means defines a complemental catch therefor.

10. The display system of claim 4 wherein the first and second elements of the bracing means include a pair of elongated arms, each arm having one end thereby hingedly connected to a first marginal segment of the wall member and a second end for interlockingly engaging the corresponding second end of the other arm when the wall member assumes the predetermined non-planar configuration.

* * * * *

UNITED STATES PATENT AND TRADEMARK OFFICE

CERTIFICATE OF CORRECTION

PATENT NO. : 4,865,111

DATED : September 12, 1989

INVENTOR(S) : Simon G. A. Perutz

It is certified that error appears in the above-identified patent and that said Letters Patent is hereby corrected as shown below:

Column 2, line 9, the word "an" should be inserted before "exploded".

Column 7, line 14, "operative" should be "inoperative"

Column 8, lines 13 and 14, the word "distal" should be inserted before "second".

Signed and Sealed this

Twenty-fourth Day of July, 1990

*Attest:*

HARRY F. MANBECK, JR.

*Attesting Officer*

*Commissioner of Patents and Trademarks*